United States Patent [19]

Bohnhoff

[11] Patent Number: 4,986,699

[45] Date of Patent: Jan. 22, 1991

[54] SOIL FILTRATION AND WATER DRAINAGE DEVICE

[76] Inventor: William W. Bohnhoff, 12501 E. Amherst Cir., Aurora, Colo. 90014

[21] Appl. No.: 63,328

[22] Filed: Jun. 18, 1987

[51] Int. Cl.[5] ..... E02B 11/00; E02B 9/04

[52] U.S. Cl. ..... 405/50; 210/170; 405/36; 405/127

[58] Field of Search ..... 405/36, 38, 43, 45, 405/50, 52, 127; 210/170, 242.1, 799; 47/66, 48.5

[56] References Cited

U.S. PATENT DOCUMENTS

| | | | |
|---|---|---|---|
| 344,813 | 7/1886 | Bull et al. | 405/127 |
| 3,408,818 | 11/1968 | Hemphill | 405/50 X |
| 3,441,140 | 4/1969 | Thurber | 405/50 X |
| 4,582,609 | 8/1986 | Hunter et al. | 210/170 X |
| 4,679,963 | 7/1987 | Heath | 405/36 |

FOREIGN PATENT DOCUMENTS

| | | | |
|---|---|---|---|
| 2327618 | 12/1974 | Fed. Rep. of Germany | 405/50 |
| 42903 | 3/1980 | Japan | 405/127 |
| 737557 | 6/1980 | U.S.S.R. | 405/127 |

*Primary Examiner*—David H. Corbin

[57] ABSTRACT

A pillow adapted for use as a soil filtration and water drainage device. The pillow includes a plurality of substantially oblong, rounded, noncompressible, noncollapsible, water resistant, non-biodegradable, and nonflammable pellets. The pellets are normally about one-half inch to two inches long. The pellets are enclosed by an outer, flexible membrane permeable to water, but impermeable to soil. Thus, water, but not soil, may pass through the membrane and around the pellets. The pillow is deformable, yet sturdy and readily adapts to the shape of the surrounding soil and other materials. Moreover, the pillow is lightweight and inexpensive.

37 Claims, 3 Drawing Sheets

SOIL FILTRATION AND WATER DRAINAGE DEVICE

BACKGROUND OF THE INVENTION

This invention relates to a soil filtration and water drainage device that permits the free flow of water therethrough, but prohibits surrounding soil from ingressing therein and moving therethrough. The device is relatively light weight, inexpensive, non-biodegradable, and substantially deformable to adapt to any desired configuration with respect to the surrounding soil or other material.

Perhaps the simplest of soil drainage devices and systems is simply the placement of sand, gravel or rocks in selected locations in the soil. Such systems permit the flow of water therethrough, but gradually become clogged with soil, which inhibits the flow of water. Although such systems are usually relatively inexpensive and readily conform to the surrounding soil and other material, such systems are very heavy.

Another type of simple soil drainage system is the provision of a series of perforated pipes at selected locations within the soil to carry away water. Such systems are usually used in combination with surrounding sand, gravel or stone to minimize the flow of soil into the pipes, which would eventually congest the flow of water into and through the pipes. Such systems are moderately expensive and moderately adapt to the surrounding soil and other materials and are moderately effective. Such systems are also relatively heavy.

Yet another soil drainage system utilizes one or two sheets of porous geotextile fabric covering an open structural material through which water can flow. The structural material usually includes raised plastic cones or stiff plastic threads and offers a relatively thin drainage profile. Such sheets are usually flexible in only one plane and are especially adapted to be disposed adjacent to concrete foundation walls. They prevent the surrounding soil from compressing directly against the foundation wall and permit water to flow within or between the structural material. This system is reletively expensive to manufacture and install.

A more recent soil drainage system incorporates a drainage panel or board having a sheet of geotextile filter fabric along one surface thereof. The board is fashioned of several small polystyrene beads bonded together and encapsulated by an asphalt adhesive. The geotextile filter fabric permits water, but not soil, to pass therethrough. The board is oriented such that the geotextile filter fabric faces the surrounding soil, and water, but not soil, is permitted to pass through the geotextile filter fabric and through the board. The board is rigid, water resistant, and combustible. Moreover, the board is relatively expensive, and not readily adaptable to the shape of the surrounding soil and other materials.

SUMMARY OF THE INVENTION

The invention relates to a pillow adapted for use as a soil filtration and water drainage device. The pillow includes a plurality of substantially oblong, rounded, noncompressible, noncollapsible, water resistant, nonbiodegradable, and nonflammable pellets. The pellets are normally about one-half inch to two inches long. The pellets are enclosed by an outer, flexible membrane permeable to water, but impermeable to soil. Thus, water, but not soil, may pass through the membrane and around the pellets. The pillow is deformable, yet sturdy, and readily adapts to the shape of the surrounding soil and other materials. Moreover, the pillow is lightweight and inexpensive.

BRIEF DESCRIPTION OF THE DRAWINGS

The invention will be described with reference to the attached drawings, wherein.

DESCRIPTION OF A PREFERRED EMBODIMENT

Figure 1:
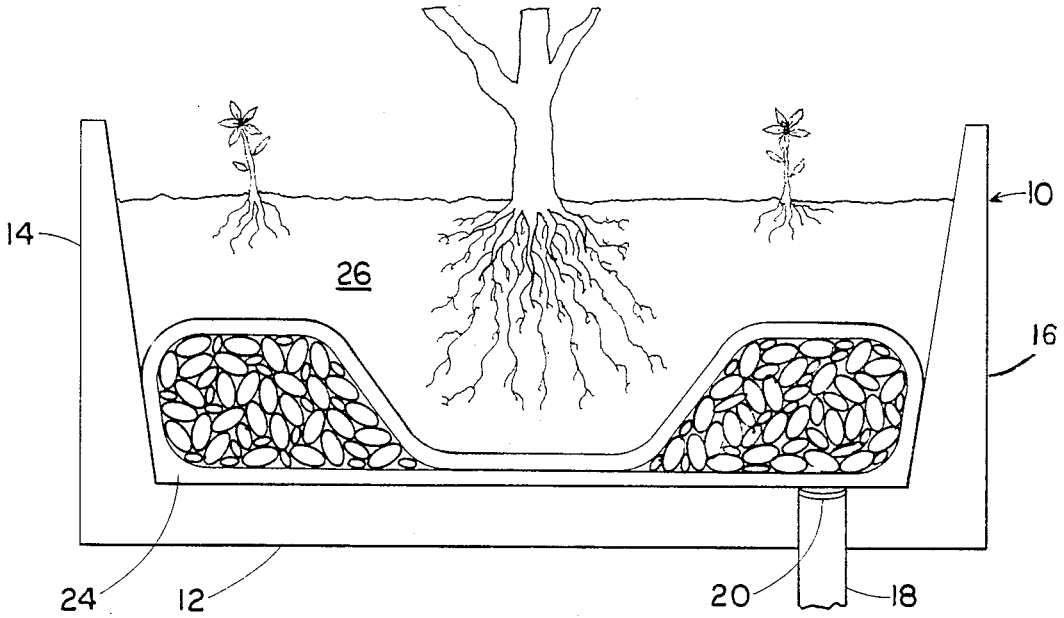
FIG. 1 is a schematic, cross section of a planter utilizing a soil filtration and water drainage device according to one embodiment of the present invention.

The invention will now be described with reference to the accompanying drawings wherein like reference numerals refer to the same item. There is shown in FIG. 1 a planter 10 utilizing a pillow adapted for use as a soil drainage device. The planter 10 includes a bottom floor 12 and a pair of opposing, upstanding walls 14, 16 extending upwardly from the edges of the bottom floor 12. The planter 10 also includes a pair of opposing, upstanding end walls (not shown) extending upward from the other two edges of the bottom floor 12. The planter 10 further includes a drainage pipe 18 extending from the bottom interior surface of the planter 10 through the bottom floor 12 for the purpose of removing excess water from within the planter 10. The upper end of the pipe 18 is provided with a screen or grating 20.

Figure 2:
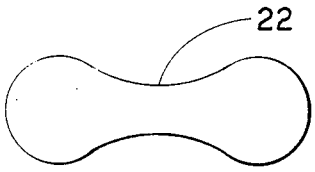
FIG. 2 is a cross-sectional view of a pellet that may be utilized with the soil filtration and water drainage device of the present invention.
Figure 3:
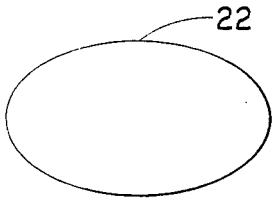
FIG. 3 is the cross-sectional view of another pellet that may be used in the soil filtration and water drainage device of the present invention.

Disposed on the bottom of the planter 10 is a pillow constructed in accordance with one embodiment of the present invention. The pillow includes a plurality of pellets 22 surrounded by an outer membrane 24. The pellets 22 are contained within the membrane 24 in a loose and non-ordered state, and the orientations of the pellets 22 within the membrane 24 are random. Preferably, the pellets 22 are substantially non-compressible, substantially noncollapsible, substantially water resistant, substantially non-biodegradable, and substantially nonflammable. Moreover, the pellets 22 are preferably oblong and possess rounded, convex surfaces. The length of the pellets 22 is preferably in the range of one-half inch to two inches, and very preferably approximately one and one-half inches. FIGS. 2 and 3 depict suitable shapes for the pellets 22. The pellet 22 shown in FIG. 2 is in the shape of a peanut, and the pellet 22 of FIG. 3 is in the shape of an egg or an elliptical spheroid. A suitable pellet is a loose dunnage formed of polystyrene manufactured by either Storopack, Inc. or American Excelsior Company. Polystyrene pellets will melt and smolder when directly exposed to flame, but will not independently support or spread a flame. Such pellets can also be treated with a flame retardant chemical to further reduce combustibility.

The membrane 24 may be formed of any material that is substantially permeable to water and substantially impermeable to soil and preferably is a geotextile filter fabric. A suitable geotextile fabric having the brand name "Trevira" is made by Hoechst Fibers Industries, a division of American Hoechst Corporation. The geotextile fabric is extremely strong, non-biodegradable, and flexible and may range in thickness from about one-eight inch to about five-eighths inch.

The pillow may be made by first forming a bag out of the membrane material 24, stuffing the bag with the pellets 22, then sealing the open end of the bag by stapling, stitching or other suitable means. It should be appreciated that the pillow can be filled to any selected degree with the pellets 22 in a range from where a relatively few pellets 22 are contained in a relatively large bag of membrane material 24 to where the pellets 22 are stuffed into and completely fill a bag of membrane material 24.

Referring again to FIG. 1, it should be appreciated that the pillow is sturdy and yet is deformable and adaptable to the shape of the interior bottom surface of the planter 10. Soil 26 or a soil-like potting mixture may be spread over the top of the pillow for growing plants. The weight of the soil helps force the pillow against the interior surfaces of the side walls 14, 16. Thus, such compression helps prevent particles of the soil 26 from seeping down along the interior surfaces of the side walls 14, 16 and into the pipe 18. The pillow will permit water, but not soil, to pass therethrough, which is readily carried away by pipe 18. Moreover, there is substantial air space within the pillow, and therefore, the plant roots will tend to avoid extending into the pillow.

The cost of the pillow is expected to be substantially less than the soil or soil mixture. Moreover, the pillow is much lighter in weight than a soil or soil mixture. Typically soil weighs in the range of seventy-five pounds (for dry, loose loam) to one hundred twenty pounds (for wet clay) per cubic foot, whereas the pillow weighs about five ounces per cubic foot. This latter characteristic of the pillow is extremely important when planters are placed on rooftops or are suspended. The flexibility and deformability of the pillows also permits the pillows to be used in a wide variety of planter shapes. Furthermore, in sections of the planter used for relatively large plants and correspondingly large root systems, either shallow, thin pillows or no pillows need be used, but with thicker pillows used in other sections of the same planter, where relatively small plants with correspondingly small root systems are planted. As shown in FIG. 1, a pillow may be only partially filled with pellets 22 to permit selected regions of the pillow to be thicker than other regions, thereby providing a corresponding selected depth of soil in selected regions of the planter.

Figure 4:
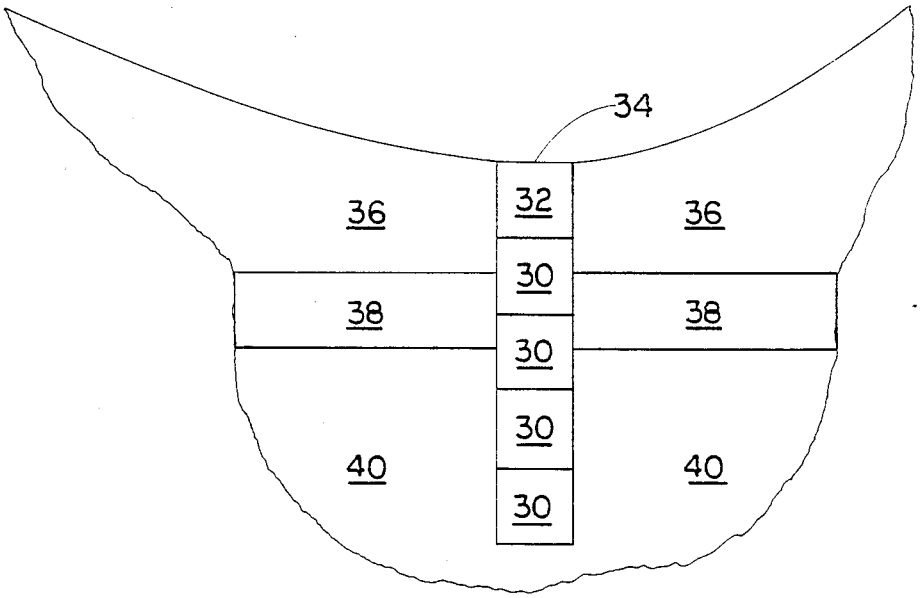
FIG. 4 is a schematic, cross-sectional view of a soil filtration and water drainage device according to the present invention disposed in a ground well.

FIG. 4 shows a ground well or trench positioned at a relatively low point in the earth's surface. The bottom and intermediate portions of the trench are packed with a series of pillows 30, and the upper portion of the trench is filled with sandy soil 32 and topped with grass 34. The bottom of the trench may be sloped so water flows along the trench and down the slope. Alternatively, a perforated pipe may be disposed in the bottom of the trench to help carry away water. The foregoing description of a trench utilizing a series of pillows is a modified version of a French drain, which utilizes sand, gravel or rock. The same series of pillows can be used in place of sand, gravel and rocks in a so-called dry well. Dry wells are used to divert water from a water permeable layer 36, around an underlying water impermeable layer 38 by passing through the dry well and the series of pillows 30, and into a lower-most water permeable layer 40 such as an aquifer.

Another use of the pillows of the present invention is to fill in the voids between boulders and in pot holes on ski slopes, especially to fill irregular surfaces on so-called rock talus fields.

Figure 5:
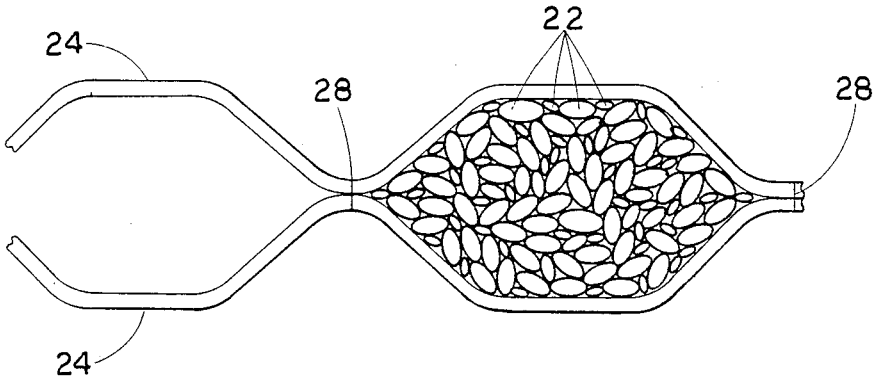
FIG. 5 is a schematic, cross-sectional view of a soil filtration and water drainage device in accordance with another embodiment of the present invention.
Figure 8:
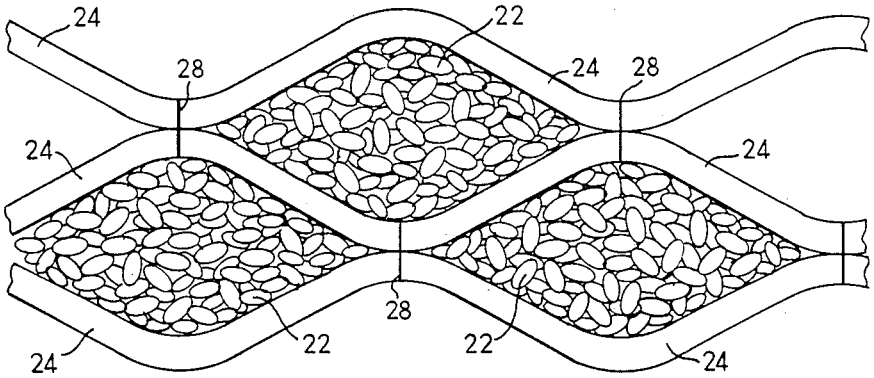
FIG. 8 is a schematic, cross-sectional view of a soil filtration and water drainage device similar to that of FIG. 5.

FIG. 5 shows a soil drainage device in accordance with another embodiment of the present invention. Such soil drainage device comprises a flexible quilt including two overlapping sheets of membrane material 24 and substantially uniform layers of pellets 22 interposed between adjacent sheets of the membrane 24. The quilt may be constructed with more than two sheets, as shown in FIG. 8, and with more corresponding layers of pellets 22. The pellets 22 are maintained in substantially uniform layers by securing the two sheets of membrane 24 along lines intermediate to the respective edges of the sheets and along the edges of the sheets, such as by stitching 28 or other suitable means. The stitched lines preferably form a grid pattern over the surface of the quilt, but alternatively other configurations such as a diamond pattern or a parallel line pattern may be used. The quilt shown in FIG. 5 (or a plurality of such quilts) may be used as a substitute for or in combination with the pillow disclosed in FIG. 1.

Figure 6:
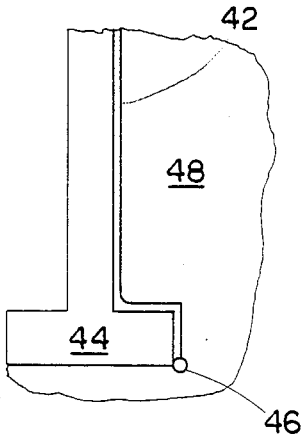
FIG. 6 is a schematic, cross-sectional view of a soil filtration and water drainage device depicted in FIG. 5 disposed along and against the outside surface of a foundation wall.

The quilt depicted in FIG. 4 may be advantageously used in a system for draining water adjacent to a foundation wall. As depicted in FIG. 6, the quilt 42 is disposed along and against the outside surface of a foundation wall 44. A perforated pipe 46 runs along the outside, lower most edge of the foundation wall 44 and is disposed immediately below the lowermost edge of the quilt 42. When used in this manner, the quilt 42 helps prevent the surrounding soil 48 from compressing directly against the foundation wall 44 and permits the surrounding ground water to flow downwardly therethrough and into the perforated pipe 46. In this particular embodiment of the invention, it would be advantageous to substitute for one of the overlapping sheets of membrane material 24 a water impermeable membrane, which membrane is disposed in abutting contact with the outside surface of the foundation wall 44. Such construction of the quilt 42 would protect the foundation 44 from the deleterious effects of water contact. It should be appreciated also that the pillow of the present invention could also be constructed with a water impermeable membrane forming a portion of the bag containing the pellets 22. Also alternatively, the water impermeable membrane could be disposed over a section of the membrane material 24.

The quilt with one outer water impermeable membrane may be disposed along the earth's surface to recover run-off from tilled soil for the purposed of reusing nutrient rich water.

The pellets 22 may be fashioned of many materials providing thermal insulation, such as polystyrene. The construction of pellets 22 from such materials as well as the air space existing between the pellets gives the pillow and the quilt of the present invention the further advantage of providing a great degree of thermal insulation.

Figure 7:
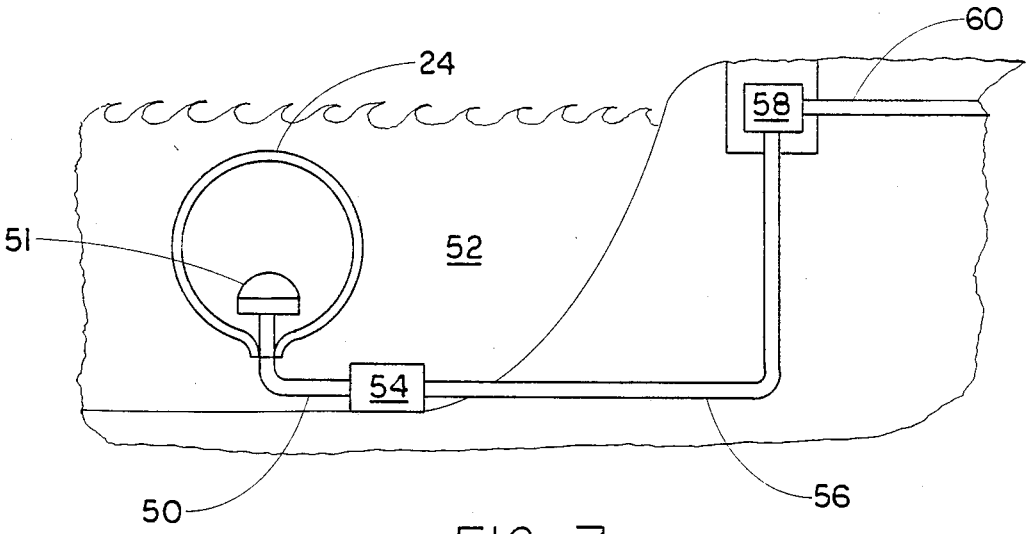
FIG. 7 is a schematic side view of a soil filtration and water drainage device in accordance with yet another embodiment of the present invention.

There is shown in FIG. 7 yet another embodiment of the soil filtration and water drainage device especially adapted for use with a water supply system. Such systems typically include a water intake pipe 50 having the mouth thereof disposed in a pond or other reservoir containing water 52. The mouth of the water intake pipe 50 is covered with a filter or screen 51. The water intake pipe 50 is connected to a pump 54 which forces water from the water intake pipe 50 through an intermediate pipe 56 to a water filter 58 and into a water outlet pipe 60. The combined effect of the screen 51 and the filter 58 helps insure that the water passed to the water outlet pipe 60 is fairly clear and clean. Nevertheless, the screen 51 and the filter 58 often become clogged, which causes the system to operate inefficiently, which causes the pump 54 to strain and work harder, and which necessitates system component cleaning, repair, and replacement. The embodiment of the present invention shown in FIG. 7 provides a very inexpensive, long lasting, and effective means for insuring that fairly clean, clear water enters the screen 51, thereby reducing the potential for clogging the screen 51 or the filter 58.

The embodiment shown in FIG. 7 includes a bag of membrane material 24 having a relatively small aperture. The bag is at least partially filled with pellets 22. The bag aperture is mounted around the water intake pipe 50 such that the screen 51 covering the mouth of the water intake pipe 50 extends into the bag interior. The bag aperture is selectively mounted tightly about the water intake pipe 50 by any suitable means, including lacing a rope through the membrane material 24 immediately adjacent to the bag aperture and then tying the ends of the rope. In this embodiment of the invention, the pellets 22 are very preferably formed of a material, such as polystyrene, that is lighter than water, whereby the pellets 22 tend to float. The floating characteristic of the pellets 22 tends to expand the bag of membrane material 24 in a balloon-like manner so that the membrane material 24 is maintained away from the screen 51, so that that the membrane material 24 is maintained with a large surface area profile, and so that the water pressure surrounding the screen 51 is approximately the same as the water pressure in the absence of the bag. It should be appreciated that the embodiment of FIG. 7 is especially useful where the water 52 is pervaded with algae, clouded with silt, or laden with debris.

Although particular embodiments of the present invention have been described and illustrated herein, it should be recognized that modifications and variations may readily occur to those skilled in the art and that such modifications and variations may be made without departing from the spirit and scope of my invention. Consequently, my invention as claimed below may be practiced otherwise than is specifically described above.

I claim:

1. A transportable pillow adapted for use as a soil filtration, water storage, or water drainage device comprising:

a plurality of pellets, said pellets being lighter than water; and a bag enclosing said pellets, said bag comprising at least in substantial part a membrane substantially permeable to water but substantially impermeable to soil, whereby water passes at a certain point through said membrane, around said pellets, and exits at another point through said membrane, said pellets contained in a loose and non-ordered state within said bag, said pillow weighing less than substantially four pounds per cubic foot.

2. A pillow according to claim 1 wherein water can enter and exit said pillow substantially only by passing through said membrane.

3. A pillow according to claim 1 wherein said membrane is flexible whereby said pillow shape is deformable.

4. A pillow according to claim 3 wherein said membrane comprises a geotextile filter fabric.

5. A pillow according to claim 1 wherein said pellets are substantially oblong and possess rounded, convex surfaces.

6. A pillow according to claim 5 wherein the longest thickness of said pellets is substantially in the range of one-half inch to two inches.

7. A pillow according to claim 1 wherein said pellets are substantially non-compressible.

8. A pillow according to claim 1 wherein said pellets are substantially water resistant and substantially non-biodegradable.

9. A pillow according to claim 1 wherein said pellets are substantially inflammable.

10. A pillow according to claim 1 wherein said bag completely surrounds and seals said pellets from the environment external of said pillow.

11. A pillow according to claim 10 wherein said pellets are substantially oblong and possess rounded convex surfaces.

12. A pillow according to claim 10 wherein said pellets are substantially non-compressible.

13. A pillow according to claim 11 wherein said pellets are substantially non-compressible.

14. A pillow according to claim 13 wherein said pellets are substantially water resistant and substantially non-biodegradable.

15. A pillow according to claim 13 wherein the longest thickness of said pellets is substantially in the range of one-half to two inches.

16. A pillow according to claim 14 wherein the longest thickness of said pellets is substantially in the range of one-half to two inches.

17. A pillow according to claim 1 wherein said bag further comprises a sheet substantially impermeable to water.

18. A planter disposed substantially above the earth's surface comprising:

a floor;

at least one wall extending upwardly from said floor, thereby defining a container open at the upper end thereof;

a transportable pillow adapted for use as a soil filtration, water storage, or water drainage device comprising:

a plurality of pellets, said pellets being lighter than water; and a bag enclosing said pellets, said bag comprising at least in substantial part a membrane substantially permeable to water but substantially impermeable to soil, whereby water passes at a certain point through said membrane, around said pellets, and exits at another point through said membrane, said pellets contained in a loose and non-ordered state within said bag, said pillow weighing less than substantially four pounds per cubic foot;

said pillow being disposed adjacent to and abuttingly with said floor and said wall; and soil or soil-like substance disposed over said pillow, said soil providing a downward pressure tending to deform said pillow into compressive abutment with said wall.

19. A drainage system for removing water from the earth's surface comprising:

a well or trench dug into the earth's surface;

a transportable pillow adapted for use as a soil filtration or water drainage device comprising:

a plurality of pellets, said pellets being lighter than water; and a bag enclosing said pellets, said bag comprising at least in substantial part a membrane substantially permeable to water but substantially impermeable to soil, whereby water passes at a certain point through said membrane, around said pellets, and exits at another point through said membrane, said pellets contained in a loose and non-ordered state within said bag, said pillow weighing less than substantially four pounds per cubic foot;

said pillow disposed within said well; and soil or a soil-like substance disposed over said pillow, said soil providing a downward pressure tending to deform said pillow into compressive abutment with the walls of said well.

20. A flexible, transportable quilt adapted for use as a soil filtration, water storage, or water drainage device comprising:

at least three flexible, overlapping sheets, at least two of said sheets being substantially permeable to water, but substantially impermeable to soil;

a substantially uniform layer of pellets interposed between each pair of adjacent sheets in a loose and nonordered state, said pellets being lighter than water, whereby water passes at a certain point through one of said two permeable sheets, around said pellets, and exits at another point through one of said two permeable sheets; and means for retaining said pellets in substantially uniform layers between adjacent sheets, said quilt weighing less than substantially four pounds per cubic foot.

21. A flexible quilt according to claim 20 wherein said retaining means includes means for securing together said sheets along lines intermediate the edges of said sheets.

22. A flexible quilt according to claim 20 wherein said pellets are substantially oblong and possess rounded convex surfaces.

23. A flexible quilt according to claim 20 wherein said pellets are substantially non-compressible.

24. A flexible quilt according to claim 22 wherein said pellets are substantially non-compressible.

25. A flexible quilt according to claim 24 wherein said pellets are substantially water resistant and substantially non-biodegradable.

26. A flexible quilt according to claim 25 wherein the longest thickness of said pellets is substantially in the range of one-half to two inches.

27. A flexible quilt according to claim 20 wherein an outer sheet is substantially impermeable to water.

28. A flexible quilt according to claim 26 wherein an outer sheet is substantially impermeable to water.

29. A pillow adapted for filtering algae, silt and other similar debris from liquid in a pond or the like before the liquid enters the mouth of an intake pipe or the like disposed in the pond, said pillow comprising:

a plurality of pellets, said pellets being lighter than the liquid and therefore having a tendency to float when disposed in the liquid; and a bag enclosing said pellets, said bag comprising at least in substantial part a membrane substantially permeable to the liquid but substantially impermeable to the algae, silt and other similar debris, the mouth of the intake pipe being disposed within said bag such that the liquid passes through said membrane and around said pellets and into the mouth of the intake pipe.

30. A pillow according to claim 29 wherein said bag possesses an aperture and wherein the intake pipe extends through said aperture.

31. A pillow according to claim 30 further including a string or rope and wherein the region of said bag surrounding said aperture is laced with said rope and wherein said rope releasably secures said bag to the intake pipe.

32. A pillow according to claim 29 wherein said pellets are contained in a loose and non-ordered state within said bag.

33. A pillow according to claim 29 wherein said membrane is flexible whereby said pillow shape is deformable.

34. A pillow according to claim 33 wherein said membrane comprises a geotextile filter fabric.

35. A pillow according to claim 29 wherein said pellets are substantially oblong and possess rounded, convex surfaces.

36. A pillow according to claim 35 wherein the longest thickness of said pellets is substantially in the range of one-half inch to two inches.

37. A pillow according to claim 29 wherein said pellets are substantially water resistant and substantially non-biodegradable.

* * * * *